United States Patent [19]

Estkowski

[11] 4,144,862

[45] Mar. 20, 1979

[54] ENGINE STARTING SYSTEM

[75] Inventor: Michael H. Estkowski, St. Joseph, Mich.

[73] Assignee: Clark Equipment Company, Buchanan, Mich.

[21] Appl. No.: 847,294

[22] Filed: Oct. 31, 1977

[51] Int. Cl.[2] ..... F01M 1/18

[52] U.S. Cl. ..... 123/196 S; 123/198 D; 184/6.4

[58] Field of Search ..... 123/196 S, 196 CP, 198 D, 123/179 A; 184/6.4; 340/270

[56] References Cited

U.S. PATENT DOCUMENTS

| | | | |
|---|---|---|---|
| 2,122,049 | 6/1938 | Stark | 123/196 S |
| 2,499,319 | 2/1950 | Lillquist | 123/196 S |
| 2,747,564 | 5/1956 | Wehling | 123/196 S |
| 2,838,039 | 6/1958 | Smith et al. | 123/196 S |

*Primary Examiner*—Ronald H. Lazarus

*Attorney, Agent, or Firm*—Kenneth C. Witt

[57] ABSTRACT

A system which normally prevents an attempt to start an engine while the engine lubricant pressure is high. However, in an emergency it is possible to crank the engine even though the lubricant pressure is high by operating the start switch and main switch in the reverse of the usual sequence.

2 Claims, 1 Drawing Figure

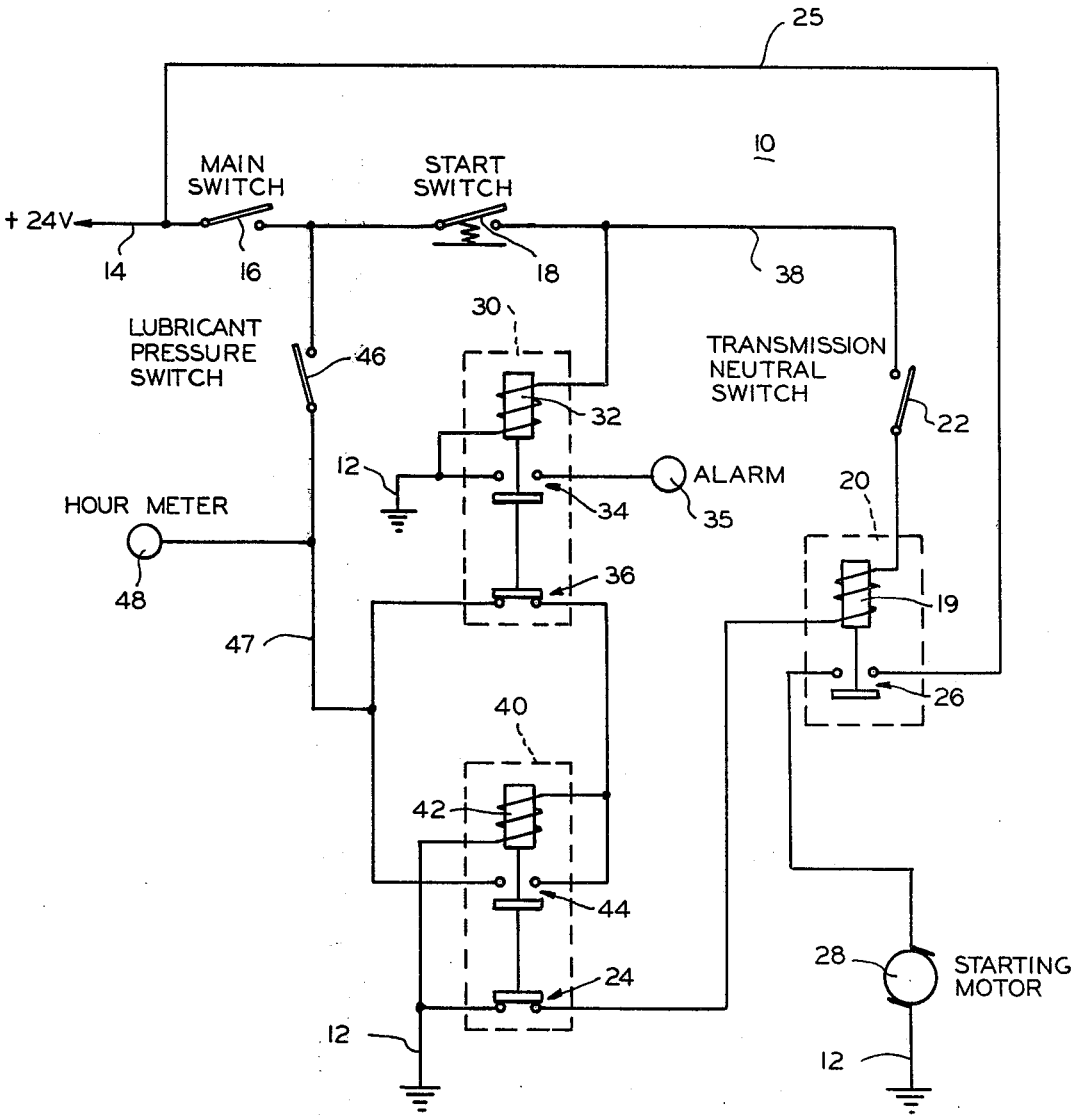
25
10
MAIN SWITCH
START SWITCH
+ 24V
14
16
18
38
30
LUBRICANT PRESSURE SWITCH
46
TRANSMISSION NEUTRAL SWITCH
32
22
12
ALARM
20
HOUR METER
34
35
36
48
19
47
26
40
42
44
28
STARTING MOTOR
24
12
12

ENGINE STARTING SYSTEM

The Government has rights in this invention pursuant to Contract No. DAAEO-7-75-C-0051 awarded by the Department of Defense.

BACKGROUND OF THE INVENTION

1. Field of the Invention

This invention relates to starting systems for internal combustion engines, and is particularly useful for such engines which must be started in an extremely cold environment although it is not limited to such usage.

2. Description of the Prior Art

It is known to employ in starting systems for internal combustion engines means to prevent an attempt to crank and start the engine when the lubricant pressure in the engine is high as a result of previous false start or for other reason. Such systems are applicable whether the engine cranking mechanism is electrical, pneumatic or other type.

It is desired normally not to attempt to start an engine when the lubricant pressure is high is because of the added stress which such a cranking and starting operation exerts on the cranking mechanism. However, under some circumstances it is important to be able to crank an engine in an attempt to start it even though the lubricant pressure in the engine remains high. An example is an engine embodied in the vehicle located in an extremely cold environment. If the vehicle is for use in emergencies it is important to provide means for carrying out such cranking when desired without requiring the operator to wait for the pressure to drop to a pressure which would permit the starting system to operate normally, or possibly causing the operator to disable or by-pass the protective device which normally prevents cranking when the engine lubricant pressure is above a predetermined amount.

The object of the present invention is to provide a system whereby the operator can readily neutralize such protective device when this becomes necessary.

SUMMARY OF THE INVENTION

In carrying out my invention in one preferred form I provide a system for operating an engine starting mechanism which has an electrical actuating device. The system includes a main switch and a momentary contact start switch connected in series with the device. A first relay having a predetermined operating time is connected to be energized when both switches are closed, such relay having a first normally closed switch. A second relay is provided having a longer operating time than the first and including a normally open switch and a second normally closed switch, the second normally closed switch being connected in circuit with the device. A normally open pressure switch responsive to lubricant pressure in the engine is provided, such switch closing when the lubricant pressure exceeds a predetermined amount. Means are provided for normally preventing operation of the device when the lubricant pressure is above the predetermined amount, including a circuit portion energized when the main switch only is closed, such circuit portion including the pressure switch, the first normally closed switch and the second relay. The normally open contacts of the second relay are connected to hold in such relay when it is energized and the pressure switch and main switch are closed; thus, the second relay holds open the second normally closed switch and normally prevents energizing the electrical actuating device when the lubricant pressure switch is closed. However, the device can be operated even though the pressure switch is closed by closing the start switch first and then the main switch, thereby causing the first relay to operate and open the first normally closed switch and thus prevent operation of the second relay.

BRIEF DESCRIPTION OF THE DRAWING

The single FIGURE of the drawing is a diagrammatic illustration of the engine starting system of the present invention.

DECSCRIPTION OF THE PREFERRED EMBODIMENT

In the single FIGURE of the drawing, the numeral 10 indicates generally an engine starting system embodying the present invention and other features. As shown, the engine starting system is adapted to be connected to opposite sides of a source of electrical energy, and in the system illustrated which is for the engine of a vehicle, the electrical source is a 24 volt DC system. The connection to one side of the electrical source, in this case the ground, illustrated at 12 while the connection to the other side of the electrical source is indicated at 14.

One circuit portion of the system includes a single pole main switch 16 connected in sequence with a momentary contact start switch 18 and the solenoid 19 of an electromagnetically operated device 20. Also connected in this circuit portion are a transmission neutral switch 22 and a normally closed switch 24 which is described later. When switches 16, 18, 22 and 24 are all closed device 20 is energized; this closes switch 26 which in the preferred mode illustrated operates a cranking mechanism for the engine which is illustrated by an electrical starting motor 28 which is energized by means of a conductor 25.

A first electromagnetically operated relay 30 is illustrated as having a solenoid 32 which operates a normally open switch 34 and a normally closed switch 36. Relay 30 is connected between conductor 38 which joins the start switch 18 and device 20 and ground which is illustrated at 12. Thus, when both the main switch and start switch are closed solenoid 32 is energized, closing switch 34 and opening switch 36.

Switch 34 operates an audible alarm 35 which forms no part of the present invention. The first normally closed switch 36 is a part of the present invention and its operation is described hereinafter.

The system includes a second electromagnetic relay device 40 which comprises a solenoid 42 operating a normally open switch 44 and a second normally closed switch 24 which has previously been identified.

A lubricant pressure responsive switch 46 is provided. Such switch is normally open but is arranged to close when the lubricant pressure in the engine exceeds a predetermined amount.

Another circuit portion of the system includes conductors connecting switch 46 in circuit with solenoid 42 between the two sides of the electrical energy source. A conductor connected to the pressure switch is indicated at 47, and it will be appreciated that a circuit can be completed from conductor 47 through solenoid 42 through either of two parallel branches, one including switch 36 and the other switch 44. If the main switch 16 and pressure switch 46 are both closed, and either switch 36 or 44 is closed, then solenoid 42 is energized and the relay 40 is held in the energized condition. It will be appreciated that normally open switch 44 provides a hold in circuit for the solenoid 42 while switch 36 provides for operating the solenoid 42 initially.

An hourmeter 48 is shown connected to conductor 47 in the usual manner but this also is not a part of the present invention.

In normal operation of this system, the main switch 16 is closed first in order to connect the remainder of the system for operation. Then, assuming that the transmission shift lever is in neutral so that the switch 22 is closed, if the start switch 18 is depressed and closed the device 20 is energized, closing switch 26 and energizing the starting motor 28 to crank the engine. The closing of both the main switch and the starting switch also energizes relay 30, closing switch 34 and sounding the audible alarm. The switch 36 is open while relay 30 remains energized.

After the engine has started and the lubricant pump has built up the pressure in the engine lubricating system the switch 46 closes and among other things this energizes and operates the hourmeter 48.

The closing of switch 46 also causes relay 40 to be energized. This occurs because all switches are closed in a circuit portion which includes the main switch 16, pressure switch 46, conductor 47 and switch 36 and which connects solenoid 42 between the two sides of the electrical energy source. Switch 36 is open when relay 30 is energized but closes when the engine starts and start switch 18 is released deenergizing relay 30.

Once solenoid 42 is energized it is held in by means of switch 44 which remains closed even though switch 36 is subsequently opened. As long as solenoid 42 remains energized, which in normal operation continues as long as pressure switch 46 remains closed, the switch 24 remains open. When switch 24 is open the circuit portion which includes the main switch 16, start switch 18 and device 20 cannot be energized.

If the engine should run only briefly, for example, and then die, the present system makes it impossible normally to attempt to restart the engine until the lubricant pressure has dropped below a predetermined amount which causes switch 46 to open. If switch 46 remains closed then it is not possible to attempt to restart the engine without special action by the operator.

Under some conditions it is desired to crank the engine even though there has been a previous false start or for other reason the lubricant pressure is above the predetermined amount which closes switch 46. This can be accomplished with the present system because relay 30 operates more rapidly than relay 40. Such timing can be accomplished by selecting a smaller relay for relay 30 than the one used for relay 40, or the relays can be otherwise timed so that relay 30 operates more quickly than relay 40.

In order to energize the device 20 and operate the starting motor while pressure switch 46 is closed both the main switch 16 and the start switch 18 are opened. This deenergizes relay 40 even though switch 46 is still closed. Then, start switch 18 is closed first, after which the main switch 16 is closed. This energizes relay 30, since it operates more quickly, and opens contacts 36, thus preventing relay 40 from operating. Since relay 40 does not operate switch 24 remains closed so that the circuit portion including main switch 16, start switch 18, device 20 and switch 24 is completed, thus causing operation of the starting motor. It is possible by initiating operation in this manner, that is, by operating the start switch and the main switch in the reverse of their usual sequence, to operate the starting motor for as long a time as is desired.

While I have illustrated and described herein the best mode contemplated for carrying out my invention it will be appreciated that modifications may be made. Accordingly, it should be understood that I intend to cover by the appended claims all such modifications which fall within the true spirit and scope of my invention.

I claim:

1. An engine starting system comprising a circuit portion connectible between the two sides of an electrical energy source and including in sequence a main switch, a start switch and a device for energizing the engine starter, a first electrically operated relay having a predetermined operating time and embodying a normally closed switch, a second electrically operated relay having a longer operating time than said first relay and embodying a normally open switch and a second normally closed switch, means for connecting said first relay between one side of the energy source and said circuit portion between said start switch and said device, a normally open switch responsive to engine lubricant pressure, means for connecting said second relay and said engine lubricant switch in sequence between said one said of the energy source and said circuit portion between the main switch and the start switch, said last named means including a parallel connection embodying said first normally closed switch and said normally open switch, and said second normally closed switch being connected in circuit with said device.

2. A system for operating an engine starting mechanism having an electrical actuating device, comprising a main switch and a momentary contact start switch connected in series with the said device, a first relay having a predetermined operating time and connected to be energized when both said switches are closed, said first relay having a first normally closed switch, a second relay having a longer operating time than said first relay and including a normally open switch and a second normally closed switch, the said second normally closed switch being connected in circuit with said device, a normally open pressure switch responsive to lubricant pressure in the engine, means for normally preventing operation of said device when said pressure switch is closed including a circuit portion energized when the main switch only is closed, said circuit portion including said pressure switch, said first normally closed switch and said second relay, said normally open switch of the second relay connected to hold in said second relay when it has been energized, whereby said device can be operated even though said pressure switch is closed by opening said main switch to deenergize said second relay and closing said start switch first and then said main switch, thereby causing said first relay to operate and open said first normally closed switch and said circuit portion, preventing the operation of said second relay and the consequent opening of said second normally closed switch.

* * * * *